US010616977B2

(12) United States Patent
Newton et al.

(10) Patent No.: US 10,616,977 B2
(45) Date of Patent: Apr. 7, 2020

(54) LIGHTING STRIP

(71) Applicant: SIGNIFY HOLDING B.V., Eindhoven (NL)

(72) Inventors: Philip Steven Newton, Eindhoven (NL); Bartel Marinus Van De Sluis, Eindhoven (NL); Dzmitry Viktorovich Aliakseyeu, Eindhoven (NL); Jochen Renaat Van Gheluwe, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/062,490

(22) PCT Filed: Dec. 6, 2016

(86) PCT No.: PCT/EP2016/079834

§ 371 (c)(1),
(2) Date: Jun. 14, 2018

(87) PCT Pub. No.: WO2017/102419

PCT Pub. Date: Jun. 22, 2017

(65) Prior Publication Data

US 2018/0376566 A1 Dec. 27, 2018

(30) Foreign Application Priority Data

Dec. 18, 2015 (EP) ..... 15201163

(51) Int. Cl.

| | |
|---|---|
| ***H05B 37/02*** | (2006.01) |
| ***H05B 33/08*** | (2020.01) |
| ***F21S 4/24*** | (2016.01) |

(52) U.S. Cl.

CPC ..... *H05B 37/0254* (2013.01); *F21S 4/24* (2016.01); *H05B 33/0857* (2013.01); *H05B 37/029* (2013.01); *H05B 37/0272* (2013.01)

(58) Field of Classification Search

None

See application file for complete search history.

(56) References Cited

U.S. PATENT DOCUMENTS 6,720,745 B2 * 4/2004 Lys ..... A61N 5/0616 315/294
7,132,804 B2 * 11/2006 Lys ..... H05B 33/0803 315/292

(Continued)

FOREIGN PATENT DOCUMENTS

WO WO2012145766 A2 10/2012

*Primary Examiner* — Alexander H Taningco
*Assistant Examiner* — Srinivas Sathiraju
(74) *Attorney, Agent, or Firm* — Daniel J. Piotrowski

(57) ABSTRACT

Linear array of lighting nodes (3) which are connected at different respective positions along a flexible, rigid or malleable continuous supporting line (6). One or more attachable dividers (5) are provided, configured to be mechanically attachable by a user onto the line (6) without severing the line, or at least without completely severing the line, each attachable between a respective neighbouring pair of the lighting nodes (3). Each of the attachable dividers (5) is configured so as, when attached to the line (6), to enable detection of a position at which the divider (5) is connected along the line (6) relative to the lighting nodes (3), and configured to provide information related to said position to a controller (7), thus dividing the lighting nodes into different segments along the line. The controller (7) is configured to apply a different lighting effect to the illumination emitted by the lighting nodes (3) in each of some or all of the different segments.

12 Claims, 7 Drawing Sheets

(56) References Cited

U.S. PATENT DOCUMENTS 7,982,335 B2 * 7/2011 Aldag ..... H01R 25/142 307/11
8,052,303 B2 * 11/2011 Lo ..... F21V 5/00 315/185 R
8,299,719 B1 * 10/2012 Moshirnoroozi .. H05B 33/0806 315/185 R
8,398,261 B2 * 3/2013 Nall ..... F21V 21/002 315/294
8,410,726 B2 * 4/2013 Dau ..... H05B 33/0845 315/312
8,641,228 B1 * 2/2014 Drake ..... F21V 21/15 362/217.14
8,807,796 B2 * 8/2014 Li ..... H05B 33/0803 315/312
9,057,504 B2 6/2015 Levante et al.
9,078,313 B2 * 7/2015 Recker ..... H05B 33/0815
9,155,170 B2 * 10/2015 Shah ..... H05B 33/0803
9,157,582 B2 * 10/2015 Pijlman ..... G02B 6/0046
9,192,008 B2 * 11/2015 Eckel ..... H05B 33/0842
9,371,983 B2 * 6/2016 Engelen ..... F21V 21/14
9,523,486 B2 * 12/2016 Boyink ..... H05B 33/0857
9,539,932 B2 * 1/2017 Fay ..... B60Q 1/0088
9,706,608 B2 * 7/2017 Fukano ..... H01R 13/7175
9,803,843 B2 * 10/2017 Engelen ..... F21V 21/14
9,816,695 B2 * 11/2017 Hsue ..... H05B 33/086
9,945,520 B2 * 4/2018 Jiang ..... F21V 3/061
10,145,552 B2 * 12/2018 Fay ..... F21V 29/70
2006/0197474 A1 * 9/2006 Olsen ..... H05B 33/0821 315/312
2010/0164409 A1 * 7/2010 Lo ..... H05B 33/0803 315/312
2011/0163681 A1 * 7/2011 Dau ..... F21K 9/235 315/191
2014/0049980 A1 * 2/2014 Pijlman ..... F21S 2/005 362/602
2014/0092622 A1 * 4/2014 Pijlman ..... G02B 6/0046 362/555
2014/0191668 A1 * 7/2014 Engelen ..... F21V 21/14 315/159
2014/0252986 A1 * 9/2014 Safar ..... F21V 23/0435 315/294
2015/0054408 A1 * 2/2015 Wlodarczyk ..... H05B 33/0809 315/137
2015/0241035 A1 8/2015 Dankelmann et al.
2016/0227618 A1 * 8/2016 Meerbeek ..... H05B 33/0803
2016/0273723 A1 * 9/2016 Van Gheluwe ..... E06B 7/28
2016/0284177 A1 * 9/2016 Lo ..... G08B 7/066
2016/0320023 A1 * 11/2016 Meerbeek ..... H05B 33/0857
2017/0359875 A1 * 12/2017 Engelen ..... H05B 33/0821
2018/0332689 A1 * 11/2018 Clout ..... H05B 37/0254
2018/0376566 A1 * 12/2018 Newton ..... H05B 33/0857

* cited by examiner

LIGHTING STRIP

CROSS-REFERENCE TO PRIOR APPLICATIONS

This application is the U.S. National Phase application under 35 U.S.C. § 371 of International Application No. PCT/EP2016/079834, filed on Dec. 6, 2016, which claims the benefit of European Patent Application No. 15201163.1, filed on Dec. 18, 2015. These applications are hereby incorporated by reference herein.

TECHNICAL FIELD

The present disclosure relates to a linear array of lighting nodes, such as a string or strip of LED-based lamps.

BACKGROUND

It is known to provide a luminaire in linear form, e.g. an LED strip or LED string. A luminaire having such a structure comprises a linear supporting element (line) such as a strip or cable, and a plurality of lighting nodes arranged in a row along the length of the line, each node comprising at least one lamp (lighting element). The supporting line comprises a power line arranged to supply power to each of the lighting nodes. The supporting line may also comprise a data bus for signalling data from a control box to each of the nodes, with each node being individually addressable, thus enabling the control box to control each of the lighting nodes (e.g. to dim the emitted illumination up or down, and/or change the colour of the emitted illumination). For instance the control box may control the lighting nodes to emit light a synchronized coloured sequence.

In the case of an LED strip the supporting line takes the form of a strip of plastic, with the power line and data bus being embedded in the insulating plastic of the strip. LED strips are cheap to produce and versatile. Typically these LED strips are provided to consumers on a roll with a self-adhesive backing. The strips can also be cut to a desired length by a user. It is then up to the user how and where to mount the strips. Usually such strips are mounted out of direct view in coves, cupboards or under furniture to create a coloured ambient light effect. LED strips are available with individually controllable LEDs.

For instance U.S. Pat. No. 9,057,504 discloses a solderless connector for enabling a user to connect together lengths of flexible LED strips. The strips can also be connected by a similar connection to a control unit, which can control the LEDs to produce a certain pattern in response to RF commands from a user.

In the case of an LED string, or indeed a string of another type of lighting node such as filament bulbs, the supporting line may take the form of a cable or a pair of twisted cables, with the power line and data lines embedded in the exterior insulation of the cable(s). Such strings are used mainly for decorative lighting, e.g. for Christmas tree lights or for decorative outdoor lighting. Different LED string configurations are available, together with a range of decorative "lamp" shades that users can simply click onto the light string.

U.S. Pat. No. 8,299,719 relates to to an individually selective intelligent serial lighting system (in other words: an LED strip), wherein lighting elements are arranged in a specific configuration so that unknown location and identity of each randomly distributed registered integrated circuit switch device, which drives lighting elements, is automatically detected, recorded and addressed. The LED strip may comprise a rear end connector which is used to attach another LED strip to the LED strip.

SUMMARY

A problem is how to enable a user to more readily configure an LED strip, string or the like. Particularly, while the above-mentioned technologies allow users to create a desired physical arrangement by connecting together lengths of LED strip or clicking modular lampshades onto a string, they do nothing to augment the functionality in terms of the design of the actual emitted illumination.

According to one aspect disclosed herein, there is provided a kit of parts comprising: a linear array of lighting nodes connected at different respective positions along a flexible, rigid or malleable continuous supporting line, each of the lighting nodes comprising one or more lighting elements for emitting illumination; one or more attachable dividers configured to be attachable by a user onto said line without severing the line, or at least without completely severing the line, each between a respective neighbouring pair of the lighting nodes, by means of a mechanical attachment; and a controller for controlling the illumination emitted by each of the lighting nodes. Each of the attachable dividers is configured so as, when attached to the line, to enable detection of a position at which the divider is connected along the line relative to the lighting nodes, and configured to provide information related to said position to the controller, and thereby divide the lighting nodes into different segments along the line. Further, the controller is configured to apply a different lighting effect to the illumination emitted by the lighting nodes in each of some or all of the different segments.

According to another aspect disclosed herein, there is provided a system comprising: a linear array of lighting nodes connected at different respective positions along a flexible, rigid or malleable continuous supporting line, each of the lighting nodes comprising one or more lighting elements for emitting illumination; one or more attachable dividers attached onto said line without severing the line, or at least without completely severing the line, each between a respective pair of the lighting nodes, by means of a mechanical attachment; and a controller arranged to control the illumination emitted by each of the lighting nodes; wherein each of the attachable dividers is configured so as, when attached to the line, to enable detection of a position at which the divider is attached along the line relative to the lighting nodes, and configured to provide information related to said position to the controller, and thereby divide the lighting nodes into different segments along the line; and wherein the controller is configured to apply a different lighting effect to the illumination emitted by the lighting nodes in each of some or all of the different segments.

Thus the present disclosure provides means to allow consumers to create or modify a luminaire comprising a linear array of lighting nodes that provide decorative and/or functional light, wherein the disclosed means enable the end-user to freely position and attach elements along the linear structure, and moreover to control the lighting effects based on the positions of the attached elements. This advantageously enables the user to more readily create a desired lighting pattern, by means of modular dividing elements which are straightforward and intuitive to use, with the division of the line into different lighting sections being handled (at least partially) automatically by the system based on the positions of the mechanical attachments as placed by the user.

In embodiments each of the attachable dividers may comprise a clip for implementing said mechanical attachment by clipping to the supporting line. A clip is a particularly easy-to-use and intuitive form of divider for the user.

The supporting line comprises a continuous line, and each of the attachable dividers is configured to implement said mechanical attachment by: being attached onto the line without severing the line, or at least without completely severing the line. Thus advantageously, the user need not be required to cut the LED strip into separate lengths.

In embodiments, the kit or system comprises a sequential data link connecting a linear sequence of data nodes, each but a first of the data nodes in the sequence being arranged to receive data from a preceding one of the data nodes in the sequence and pass the data to a next one of said data nodes in the sequence; wherein said lighting nodes each comprise a respective one of the data nodes. In such embodiments, each of the attachable dividers may be configured so as, when attached to the supporting line by said mechanical attachment, to intersect the data link to become another of said data nodes in the sequence between the neighbouring lighting nodes, and to thereby communicate with at least one of the respective pair of neighbouring lighting nodes in order to enable said detection. Thus by intercepting the data link (e.g. serial bus), the clip or other such divider becomes one of the nodes on the bus. For instance if the link is a serial bus, i.e. with a daisy-chain topology, then the clip or divider is inserted as a new node in the daisy-chain between two previously-adjacent lighting nodes. This provides a neat way for the divider to communicate with its neighbours in order to discover the addresses of its neighbours, and to thereby implement the division of the array into segments by reference to the bus addresses.

In embodiments, the kit or system comprises a power line arranged to power to each of the lighting nodes; wherein each of the attachable dividers is configured so as, when attached to the supporting line by said mechanical attachment, to connect to the power line and thereby draw power to power the attachable divider. Thus the dividers can advantageously tap into the line's power supply in order to power their own circuitry.

Alternatively, each of the attachable dividers may be configured so as, when attached to the supporting line by said mechanical attachment, to connect to the power line and thereby supply power for powering the lighting nodes. This can be particularly advantageous in the case of long lines where power delivery along the whole line can become a problem (e.g. with each LED drawing 60 mA, a strip of more than one or two hundred LEDs can start to experience difficulty supplying enough power). In embodiments where the attachable dividers also deliver power however, this advantageously provides a boost at each of one or more positions part way along the strip or line.

In embodiments, the data link and/or power line may be comprised within the supporting line. Thus the supporting line provides both (a) mechanical support, and (b) electrical insulation and/or protection for the data link and/or power line within it.

In embodiments, each of the attachable dividers comprises contacts for piercing the supporting line to make electrical contact with the data link to perform said communication with the at least one neighbouring lighting node, and/or for piercing the supporting line to make electrical contact with the power line in order to perform said drawing or supply of power. This provides a particularly easy-to-use form of clip or divider for the user—all the user need do is attach the clip (or such like) and this action at the same time inherently pierces the supporting line to make the relevant contacts with the data link and/or power line.

In embodiments, each of the attachable dividers may comprise a blade for severing at least the data link in order to create said intersection. In some embodiments, the blade may also sever power line in order to make said connection to the power line to draw or supply power. In the case where the supporting line itself is severed, optionally the blade may also be configured to perform said severing of the supporting line. Thus even in embodiments where the strip or other such line does need to be severed, the user does not need to perform a separate cutting action with scissors or a knife, and in particularly preferred embodiments the user simply attaches the clip (or other such divider) and this action inherently also causes the blade to perform the severing. E.g. the blade may be included on the inside of the clip, so that when the clip is closed by the user, the blade closes in on the data link, power line and/or supporting line in order to sever it.

In embodiments, each of the attachable dividers may be configured to enable said detection based on a wireless signal transmitted or reflected between the attachable divider and at least one of the respective pair of neighbouring lighting nodes, or between the attachable divider and a component embedded in the line. Such embodiments require no interception of a wired data line.

For example, each of the attachable dividers may be configured to enable said detection based on a signal transmitted to or from at least one of the respective pair of neighbouring lighting nodes, or to or from a component embedded in the line; and each of the attachable dividers may comprise a wireless receiver or transmitter configured to transmit or receive said signal wirelessly. For instance said wireless communication technology may comprise a near-field communication (NFC) transmitter or receiver arranged to transmit or receive said signal via a NFC technology. E.g. the attachable divider may comprise an RF tag reader arranged to read an RF tag embedded in the at least one neighbouring lighting node or embedded in the line, or the attachable divider may comprise an RF tag arranged to be read by an RF tag reader embedded in the at least one neighbouring lighting node or embedded in the line.

As another example, each of the attachable dividers may comprise a reflective surface arranged to enable said detection based on light from the at least one neighbouring lighting node being reflected back from the reflecting surface to a light sensor included in the neighbouring lighting node(s) or embedded in the supporting line.

In embodiments, at least one of the attachable dividers may be further arranged to mechanically support or be supported by a luminaire element. E.g. this may be a decorative luminaire element (e.g. lamp shade), and/or a passive optical element (e.g. diffuser material), and/or a structural luminaire element (e.g. chandelier arm). Thus advantageously, as well as dividing the array of lighting nodes into segments, the clips (or other such dividers) also enable an additional function of providing mechanical support.

In some such embodiments: for said at least one attachable divider, said communication between the attachable divider and the at least one neighbouring lighting node may further enable identification of a property of the luminaire element; and the controller may be configured to control the lighting effect in one of the segments bounded by said at least one attachable divider in dependence on the identified property of the luminaire element. For instance, the identified property may comprise a type, shape, size or colour of the element. The property may be identified based on identifying an ID of the element, and then identifying a property associated with the ID. E.g. the ID may be detected via the data link or via a wireless signal, in a similar manner as mentioned above.

In embodiments where the identified property comprises a type of the luminaire element, the type may be detected from amongst a set comprising some or all of: a decorative luminaire element, a passive optical element, and/or a structural luminaire element. E.g. the type of luminaire element may be detected from amongst a set comprising some or all of: a light shade, a light diffusing element, and a chandelier arm.

According to another aspect disclosed herein, there is provided a method performed in relation to a linear array of lighting nodes connected at different respective positions along a flexible, rigid or malleable continuous supporting line, each of the lighting nodes comprising one or more lighting elements for emitting illumination; the method comprising: attaching one or more attachable dividers onto said line without severing the line, or at least without completely severing the line, each between a respective neighbouring pair of the lighting nodes, by means of a mechanical attachment; employing a controller for controlling the illumination emitted by each of the lighting nodes; using each of the attachable dividers so as, when attached to the line, to detect a position at which each of the attachable dividers is connected along the line relative to the lighting nodes, thus dividing the lighting nodes into different segments along the line; providing information related to said position to the controller; and operating the controller to apply a different lighting effect to the illumination emitted by the lighting nodes in each of some or all of the different segments.

In embodiments, the method may comprise steps in accordance with any of the apparatus features disclosed above or elsewhere herein.

BRIEF DESCRIPTION OF THE DRAWINGS

To assist understanding of the present disclosure and to show how embodiments may be put into effect, reference is made by way of example to the accompanying drawings in which.

DETAILED DESCRIPTION OF EMBODIMENTS

Figure 1:
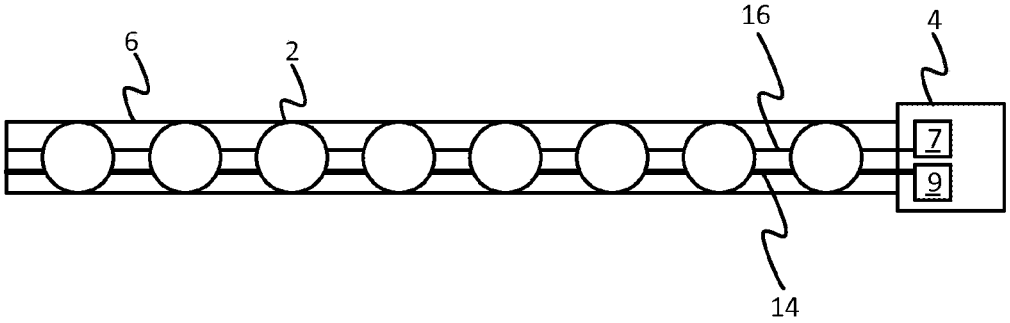
FIG. 1 is a schematic illustration of an LED strip.

The following discloses a customizable luminaire that offers the option of personalized design to a user. According to the present disclosure, the luminaire comprises: a linear array of LEDs that is addressable per cluster, a cluster being either a single LED or a subset of two or more LEDs; one or more segmentation elements such as clips that can be attached to the linear array of LEDs in order to define a plurality of segments; and a controller to separately control each segment as defined by the one or more clips.

When attached to the linear array of LEDs, the segmentation clips are capable of providing information to the controller as to their location. Based on this information the controller knows how the linear array of LEDs is segmented. A user may attach the segmentation clips to various locations on the linear array of LEDs, and the controller then allows the user to drive each of the segments as he desires. For example, a segmentation clip may be used to segment a linear array of LEDs into a first segment and a second segment, wherein the brightness of each segment can be separately controlled.

The luminaire may further comprise an optical component such as lampshade or diffuser that can be mounted on the linear array of LEDs to modify the light output of a segment, wherein the mounting means comprises a segmentation clip as defined above. These components may be passive, simple elements, that may have an optical or light-distributing function. For example, a lamp shade can be attached to the linear array of LEDs using two segmentation clips to define a first segment of LEDs whose light output will be modified by the lamp shade, and a second segment of LEDs whose light output will not be modified by the lamp shade. The controller can control the first segment to provide white light of relatively high intensity, and the second segment to provide low intensity decorative lighting.

The luminaire has a linear LED structure which may be rigid, bendable or flexible. To implement the segmentation, the clips or other such attachable elements may contain integrated circuits that actively modify and/or add control data transmitted to and/or from the LED structure. The clips may also provide mechanical support, and/or make a power connection. Furthermore, the linear structure may detect a property (e.g. type) of clip or other such mountable element and adjust the light accordingly.

Thus there is provided a luminaire with segments and attachment clips that may act as mechanical support and provide power and control to an LED strip, string or the link. The elements can be re-arranged to create a different shape. The elements have clips which allow to mount a LED strip to the element. Exposed contacts on the LED strip allow the clips to provide or draw power, and control LEDs or groups of LEDs on the LED strip. In addition the position and type of lamp shades (or other such decorative optical components) can be detected.

The system consists of various parts: a clip that can be attached to a LED strip, a system that detects at which position on the LED strip the clip is attached and luminaire elements to which the LED strip is attached through the use of the clips. The clip(s) may perform several functions, but at least segment an LED strip into sections of LEDs that may be controlled by the system. In addition the clip(s) may provide identification means to the system identifying the type of element that is attached, and/or identifying some other property such as a size, shape or colour of the element. By providing an identification means, this allows the system to identify the type of element that is attached to a (set of) LEDs of the LED strip. Such an element may be part of a luminaire such as a lampshade or an arm of a chandelier. Furthermore, specific light settings may be associated with the detected properties and those can be activated on the relevant LED nodes.

Regardless of the identification method that is used, in embodiments the clip also provides a means to hold a LED strip in place to a part of a luminaire (e.g. a lampshade or arm of a chandelier), provide power to sections of the LED strip, and/or connect LED strips together.

To detect what kind of luminaire element (e.g. an arm of a chandelier, or a lampshade) is attached at what position of the LED strip, this can be done through the use of a clip that also acts as a mechanical attachment. For instance, each luminaire element (e.g. lampshades) may be equipped with clips at the start and end of a luminaire element, which can be opened such that the LED strip can be inserted. Once the LED strip is positioned the clip is closed securing the LED strip to the luminaire element.

Mechanically the clips may be similar to existing clips that can be used to connect two parts of a LED strip together, although in embodiments of the present disclosure the clips may be extended such that at one end they can be attached to a luminaire element, for example through an additional clip or a loop.

To allow the clip or clips to segment the LED strip (or the like), the location and identity of a clip attached on the LED strip is to be determined. To this end the LED strip may be arranged to detect the clip and read information from the clip, and transfer this information to a controller. Several methods can be used to implement this, for instance:

- electrically by using a data channel on the LED strip with connectors on the LED strip and on the clip (preferred approach),
- using a RFID chip in the clip and one or more RFID readers in the LED strip to read out the codes, or
- optically by embedding light sensor(s) into the LED strip to detect the position of a clip, a property of the attached element or the position of a section of luminaire using coded light.

In the first case the clips have metal connectors and connect to the power and data lines on the LED strip. In the case of a LED strip with a single wire bus, this means the clip when attached connects to the 5V, the data line and the gnd. When the clip is used to attach the LED strip to a part of a luminaire then the clip has two parts, one that connects to the LED strip and another that connects the clip to the luminaire. For very long strips the clip could provide power from the luminaire into the LED strip and so ensure that power (and thus brightness) over the strip remains uniform. Identification of the clips depends on the type of LED strip that is used. In the single wire case the clip when attached may cut through the data-line on the LED strip and pass the data signal through a chip inside the clip. The clip is then interposed between two LEDs or it is placed over an LED, bypassing that particular LED, or interposing between this LED and the next. The clip would then insert data that signals an identifier for the clip and the identifier for the position of the clip on the LED strip and in the case of bypassing an LED, it would replace the data intended for this LED. A similar approach could be used with a LED strip with a separate clock and data line.

Alternatively the LED strip may contain an RFID reader and the clips may contain RFID ICs. In this case the LED strip can identify the clips that are attached by reading out the RFID codes from the clips. The antennas for the RFID readers may be embedded as one or more additional tracks along the length of the LED strip to create sections. The position of the clips can be determined by having multiple RFID reader ICs embedded over the length of the LED strip. Sections can be made if a clip is detected in that section, and the LEDs in that section are switched on or off (etc.).

Another alternative approach is through the use of light sensor(s) embedded in the LED strip. In this case the clips are attached at the start and end of a luminaire element or a lampshade. The clips are positioned over the LEDs, and the LEDs, which may contain a light sensor in the package, detect the light reflected back from the clip to determine whether a clip is placed there or not.

Some example implementations are now discussed in relation to FIGS. 1 to 10.

FIG. 1 illustrates a luminaire in the form of an LED strip. The LED strip comprises a supporting line 6 in the form of a strip, and a linear array of lighting nodes 2 each disposed at a different respective position along the strip 6 and each comprising one or more lamps (lighting elements). In the case of an LED strip each of the lighting nodes 2 comprises an LED-based lamp 2 comprising one or more LEDs. Control equipment 4 is connected to the strip 6, the control equipment 4 comprising a controller 7 and a power supply 9. The control equipment 4 may comprise a control box housing both the controller 7 and power supply 9, or the controller 7 and power supply 9 may be housed in separate units, or one or both of the controller 7 and power supply 9 may even be distributed along the strip. It will be appreciated that the arrangement shown in FIG. 1 is only schematic. The controller 7 may be implemented in the form of computer-readable code stored on a memory (comprising one or more memory units) and arranged to run on a processing apparatus (comprising one or more processing units). Alternatively the controller 7 may be implemented in dedicated hardware circuitry, or configurable or reconfigurable circuitry such as a PGA or FPGA.

A data link 16 runs along the length of the strip 6, connecting each of the lighting nodes 2 to the data link 16, e.g. with the material of the strip 6 arranged as an insulator formed around the data link. The data link 16 is also connected to the controller 7, thereby enabling the controller to control the lamps 2 via the data bus, at least to control the illumination emitted by the lighting nodes 2. For example the controller 7 may use this arrangement to turn the illumination on and off, dim the brightness of the illumination up and down, and/or control the colour of the illumination.

Each of the lighting nodes 2 plays the role of a data node on the bus 16. The data link 16 is a sequential data link, i.e. a linear bus, also referred to as a daisy-chained topology. That is, the first node in the sequence receives data from the controller 7, and then forwards (at least some of) the data to the next node in the sequence, which in turn then forwards (at least some of) the data to the next node in the sequence, and so forth. In embodiments, the data may be packetized and addressed to a particular one or a particular group of the nodes. E.g. when any given one of the nodes receives a packet on the serial bus 16, it examines the packet to determine whether it is addressed to that node. If not it forwards the packet to the next node in the sequence, but if so it reads that packet and then optionally removes it from the data stream being forwarded to subsequent nodes in the sequence. Thus by placing packets onto the bus directed to particular addresses, the controller 7 is able to control individual specified ones or groups of the lighting nodes 2 (such as to switch them on or off, dim them up or down, or change their colour). In embodiments the data link 16 is a single wire serial bus, but the possibility of a bus comprising multiple wires in parallel is not excluded.

A power line 14 also runs along the length of the strip, connecting each of the lighting nodes 2 to the power supply 9 in order to be powered. The power supply 9 may take any suitable form, e.g. one or more batteries, or a power supply comprising a transformer for generating a suitable power supply from a mains voltage. Note that the power line 14 does not necessarily comprise a single wire, and the form shown in FIGS. 1 (and 3 to 10) is only schematic (does not necessarily represent the actual circuit). Suitable circuitry for delivering power along an LED strip or other lighting array will in itself be familiar to a person skilled in the art.

Figure 2:
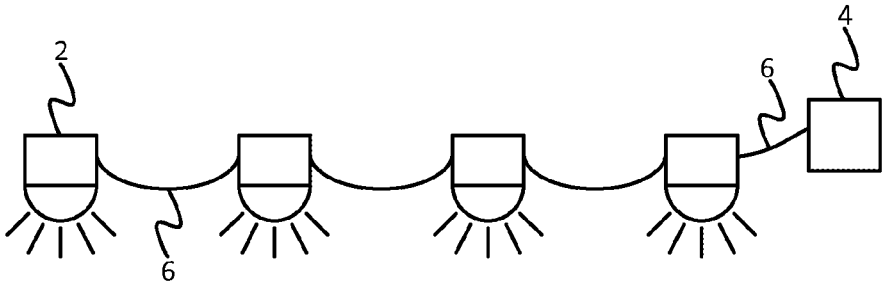
FIG. 2 is a schematic illustration of a string of LED-based lamps or other lighting nodes.

FIG. 2 shows a variant of the luminaire in FIG. 1, in which the luminaire comprises a lighting string instead of an LED strip. Here, instead of a strip, the supporting line 6 takes the form of a cable or a plurality of intertwined cables. Each of the lighting nodes 2 may again comprise an LED-based lamp, or other type of lamp or lamps such as a filament bulb. Also, somewhat summarily to FIG. 1, the data bus 16 and power line 14 run along the length of the line 6, surrounded by the exterior insulation of the cable(s), in order to communicate data between the controller 7 and lighting nodes 2 and to power the lighting nodes 2 respectively.

More generally still, the supporting line 6 may comprise any linear supporting structure such as a wire, cable, string, thread, cord, rope, strip, tape, track, pole, column, tube or pipe, etc. Referring to the total length over which the lighting nodes 2 are disposed, i.e. from the farthest lighting node 2 at one end to the farthest lighting node 2 at the other end; in embodiments, the line 6 may be more than one hundred times as long as it is wide at any point along its length (no more than one hundredth as wide as it is long anywhere along its length), or may be more than five hundred times as long as it is wide at any point along its length (no more than one five-hundredth as wide as it is long anywhere along its length).

Figure 3:
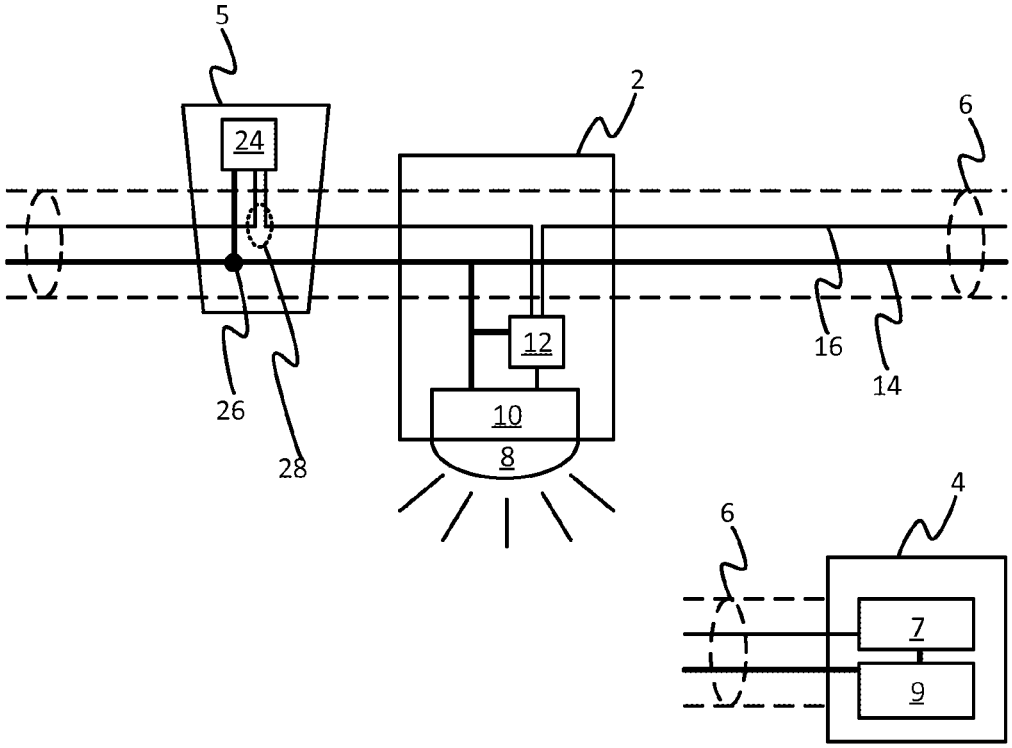
FIG. 3 is a schematic illustration of a lighting node and clip connected to a supporting line such as a string or strip.

FIG. 3 illustrates an example of how a linear luminaire such as that of FIG. 1 or 2 may be augmented by means of one or more attachable dividers 5.

As shown in FIG. 3, each lighting node 2 comprises local lighting node control logic 12, a driver 10 and one or more lamps (lighting elements) 8. As mentioned, the one or more lamps 8 in each lighting node 2 may comprise any one or more lamps suitable for emitting illumination, such as an LED-based lamp, filament bulb, gas-discharge lamps or others (and each lighting node 2 need not necessarily be of the same type, though typically they will be). The driver 10 is connected to the one or more lamps 8 and to the power line 14, and is thereby arranged to deliver power from the power line 14 to the one or more lamps 8 in order to enable it/them to emit illumination. The lighting node control logic 12 may also be connected to the power line 14 in order to be powered to perform the following functionality.

The lighting node control logic 12 may be implemented in the form of computer-readable code stored on a memory of the lighting node 2 and arranged to be run on a processor of the lighting node 2 (the memory comprising one or more memory units and the processing apparatus comprising one or more processing units). Alternatively the lighting node control logic 12 may be implemented in the form of dedicated hardware circuitry, or configurable or reconfigurable hardware circuitry such as a PGA or FPGA.

By whatever means implemented, the local lighting node control logic 12 is coupled into the linear data bus 16 (between two legs of the data bus 16), and arranged to receive the packets of data from the preceding node (or controller 7) in the linear sequence, act on any packets destined for the respective lighting node, and forward any others on to the subsequent node in the sequence (see also the above discussion). The local lighting node control logic 12 is also connected to the driver 10, in order to be able to control the driver 8 and thereby control the illumination emitted by the one or more lamps 8. If the local lighting node control logic 12 detects a packet (or packets) addressed to its own node, and that packet (or packets) defines a lighting control commands, then the local control logic 12 acts on the driver 10 in order to control the illumination emitted by the respective lamp(s) 8 in accordance with the control command (e.g. turn it on or off, dim it up or down, or set its colour).

Furthermore, there is provided at least one attachable divider 5 (and preferably more, each configured as shown and described in relation to FIG. 3 and subsequent figures). The attachable divider 5 is a component designed to be attached mechanically onto the supporting line 6 by a user (end user, i.e. consumer), in order to divide the lighting nodes 2 of the luminaire amongst different segments (though physically separate segments do not have to be created). In embodiments the attachable divider 5 may take the form of (or at least comprise) a clip for clipping onto the line 6, and will be described as such in the following (and elsewhere herein). However it will be appreciated this is not necessarily limiting, and other suitable mechanical attachment mechanisms may be used (e.g. a screw clamp).

Figure 4:
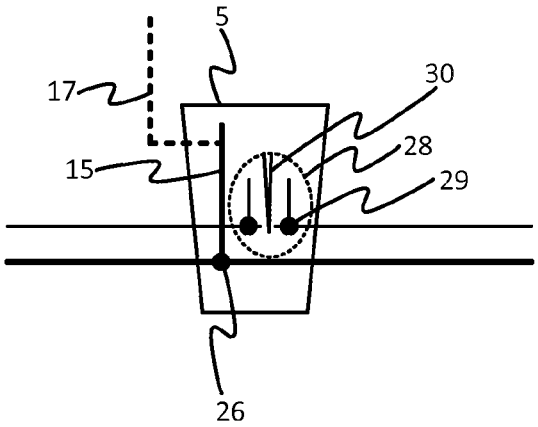
FIG. 4 is a schematic illustration of a clip attached to a supporting line.

Reference is made to FIG. 4 in conjunction with FIG. 3. As well as a clip mechanism for mechanically securing it to the line 6, the clip 5 comprises local divider logic 24, plus a mechanism for creating an electrical connection 26 between a power line branch 15 of the clip 5, and a mechanism for creating a connection 28 connecting the divider logic 24 into the linear data bus 16. Each lighting node 2 has a respective ID (address) that is unique along the bus 16, enabling that lighting node (or rather its local control logic 12) to be identified as a destination or source of communications signalled along the bus 16. Further, each of the one or more clips 5 has a respective ID that is unique along the bus 16, enabling that clip 5 (or rather its local logic 24) to be identified as a source or destination of communications signalled along the bus 16.

The divider logic 24 may be implemented in the form of computer-readable code stored on a memory of the clip 5 and arranged to be run on a processor of the clip 5 (the memory comprising one or more memory units and the processing apparatus comprising one or more processing units). Alternatively the divider logic 24 may be implemented in the form of dedicated hardware circuitry, or configurable or reconfigurable hardware circuitry such as a PGA or FPGA.

Details of an example mechanism for connecting the clip's logic 24 into the bus 16 are shown schematically in FIG. 4. Here, the clip 5 comprises a blade 30 arranged such that when the clip 5 is attached to the line 6, the blade 30 severs the data bus 16. The blade 30 may be made from an insulating material (e.g. plastic), or have an insulating coating, or may be arranged to retract again after the severing, so as not itself to make electrical contact with the bus 16. Alternatively the blade 30 may not be present, and instead the user may sever the data bus manually (e.g. using a box-cutter, wire-stripper type or scalpel type cutter knife, or scissors, or by means of perforations formed in the strip 6 in the case of an LED strip). Either way, the clip 5 also comprises a pair of contacts 29 designed so that when the clip 5 is clipped to the line 5, the contacts 29 pierce the outer insulating material of the line 6 and make electrical contact with either side of the pierced sections of the data bus 16. These connections connect to the divider logic 24, thus intersecting the bus 16 so as to insert the control logic 24 of the clip 5 as an additional data node of the linear (daisy-chained) bus 16, in between two neighbouring lighting nodes 2.

This enables the divider logic 24 in the clip 5 to communicate with the logic 12 in one or both of the neighbouring lighting nodes 2 via the bus 16. Note also that in a linear bus topology (daisy-chain), a node can tell which node is adjacent to it on the bus 16. Therefore by means of this insertion of the clip's logic 24 into the bus, it is possible to identify where the clip 5 is positioned along the line 6 relative to the lighting nodes of the array, and to communicate this fact to the controller 7. There are at least two possibilities for this. One is that the divider logic 24 of the clip 5 reads the address of one or both of its neighbouring lighting nodes 2 over the bus 16, by means of the described connection 28, and then uses this same connection 28 to communicate this/these lighting node IDs back to the controller 7 along the bus 16, along with the clip's own ID to identify the clip 5 to the controller 7. The other possibility is that the lighting node control logic 12 in each of the lighting nodes 2 reads the address of any clip 5 it finds next to itself, and reports this to the controller 7 along with the ID of the lighting node 2 itself (either the lighting nodes 2 can be configured to recognize which IDs are clip IDs as opposed to lighting node IDs and only report the ID to the controller 7 if it is a clip ID, or the lighting nodes 2 may simply be arranged to report the IDs of any neighbouring node regardless of whether it is a clip 5 or a lighting node 2 and instead the controller 7 is configured to sort out which are clip IDs, e.g. using a look-up table).

The controller 7 now knows which pair of lighting nodes 2 each of the one or more clips 5 are located between. This effectively divides the luminaire into different segments, each segment comprising a different respective exclusive contiguous run of one or more of the lighting nodes 2. The controller 7 can then control the different segments independently of one another, e.g. to turn the lighting nodes 2 of one segment off while the lighting nodes 2 in the other segment are turned on, or set the lighting nodes 2 in different ones of the segments to different dimming levels, or to set the lighting nodes in different ones of the segments to emit different colours.

Regarding the power connection 26, this may be formed in a similar manner to the data bus connection 28 as discussed above, or by other means. For example, it is not necessarily required to sever the power line 14, as depending on the circuit, the nodes 2, 5 do not have to be daisy-chained together for power purposes, i.e. the power line 14 need not have a linear (daisy-chained) topology (though that is also one possibility). Instead, the power connection 26 may just comprise one or more contacts arranged so that when the clip 5 is closed in order to clip to the supporting line 6, the contacts pierce the exterior insulation of the line 6 and make electrical contact with the power line 14, thereby connecting the clip's circuitry in parallel with the existing nodes 2.

The power connection 26 of the clip 5 connects to a power line branch 15 of the clip 5. In embodiments, this may be arranged to draw power from the power line 14 (so ultimately drawing power from the power supply 9) in order to power the clip's local divider logic 24. Alternatively, the power line branch 15 of the clip 5 may comprise an external power line branch 17 arranged to boost the power on the power line 14 (in addition to the power supply 9 and/or one or more other such connections 17 from other clips 5), or even to provide the sole power source of the power line 14. The use of the clip 5 to supply power can be advantageous for longer strips with a high LED density (and more lumen/meter). In such cases, power delivery along the strip is a problem. Each LED may consume up to 60 mA, with 144 LEDs per meter the currents may quickly become too large to safely deliver sufficient power to the LEDs at the end of the strip. Thus these strips can benefit from the power being supplemented by one or more additional power line branch 17 provided via one or more respective clips 5.

Figure 5:
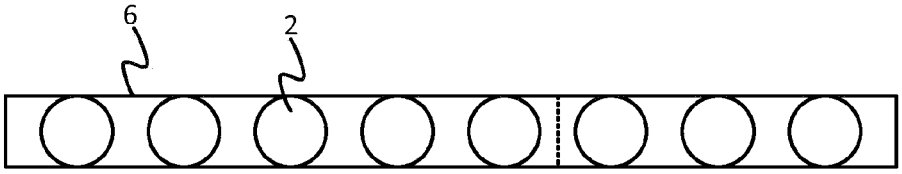
FIG. 5 is another schematic illustration of an LED strip.
Figure 6:
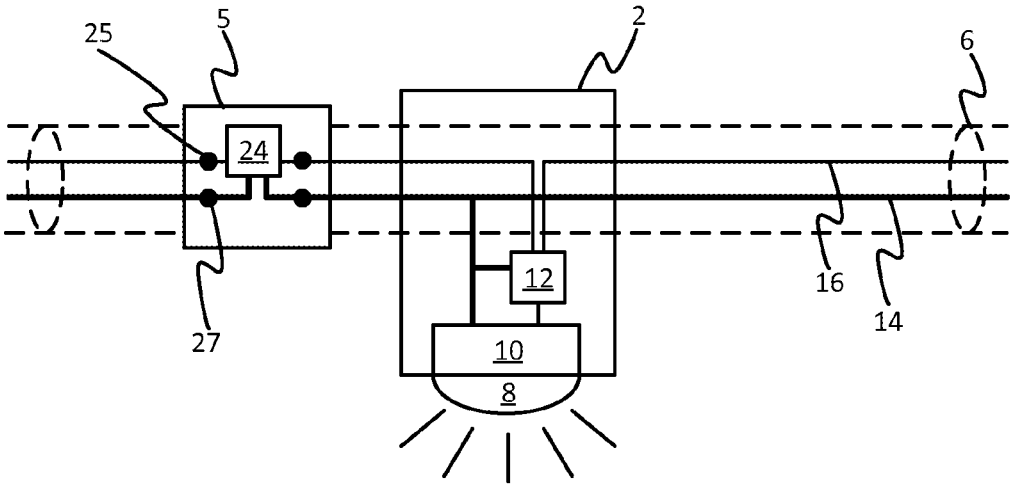
FIG. 6 is another schematic illustration of a lighting node and clip connected to a supporting line.

FIGS. 5 and 6 illustrate a variant of the arrangement shown in FIG. 3. Here, unlike FIG. 3 where the clip 5 clips onto a line 6 which remains substantially continuous (except the severing of the bus 16 and possibly power line 14), instead the supporting line 6 is completely severed at at least one point. The line 6 is completely severed at at least one point along its length, in the plane perpendicular to its length (e.g. see dotted lines in FIG. 5). For example, an LED strip may be cut by a user using scissors or a knife, or torn along perforations preformed in the strip 6. Similarly other forms of line such as the cable(s) of an LED string or other lighting string may be cut manually by a user using scissors or a knife.

The resulting parts of the line 6 are then attached to either side of the clip 5 to re-join the line, e.g. by means of a component for mechanically clamping the clip 5 to each side of the severed line 6 when the clip is closed. In addition, the clip 5 comprises, on either side, contacts 25 and 27 arranged so that when the clip 5 is closed on that side to pierce the exterior electrical insulation of the line 6 and make electrical contact with the data bus 16 and power line 14 respectively. These contacts connect the clip's divider logic 24 into the data bus 16, and also to the power line 14 to be powered. Again therefore, the diver logic 24 of the clip 5 is inserted into the linear topology of the bus 16 between two adjacent lighting nodes 2, and can be used to identify the position of the clip 5 and control the lighting accordingly, in a similar manner as described above in relation to FIG. 3.

Figure 7:
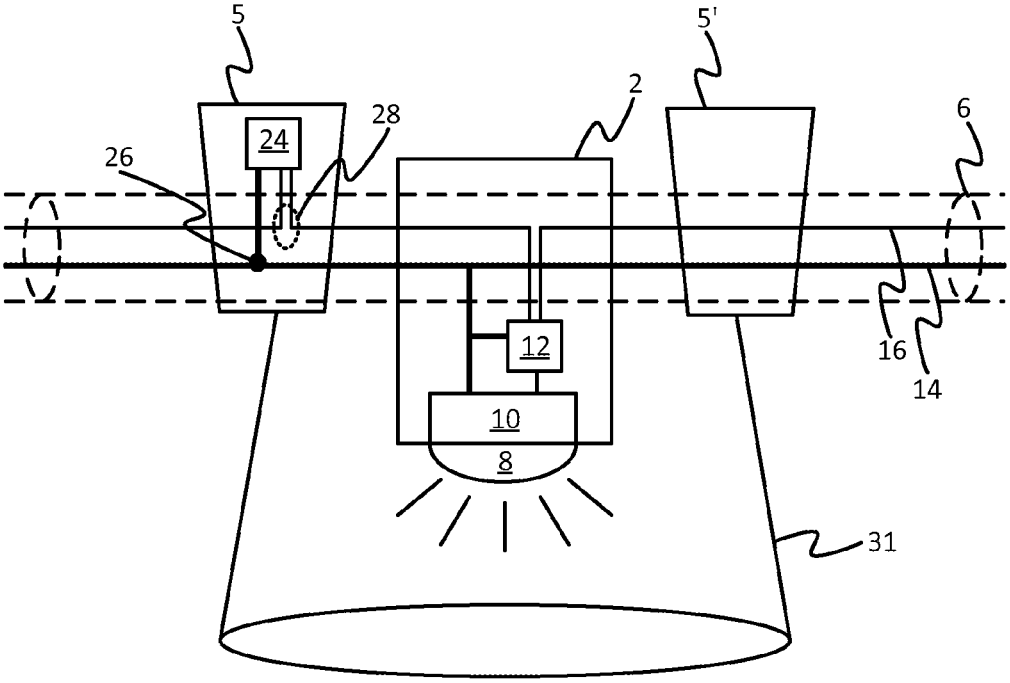
FIG. 7 is another schematic illustration of a lighting node and clip connected to a supporting line.

FIG. 7 shows a further embodiment. Here the one or more clips 5 are not only used to logically divide the luminaire, but also as a means of physical support to either support a luminaire element 31 from the supporting line 6 or support the line 6 from a luminaire element 44. In the example of FIG. 7 the clip 5 is arranged, or a plurality of such clips 5, 5' are together arranged, to support a decorative and/or passive optical luminaire element 31 such as a lampshade and/or diffuser (the lampshade may be opaque or diffusive of have a combination of opaque and diffusive sections). For example, as illustrated in FIG. 7, two clips 5, 5' may be connected or formed on either side of a lampshade or diffuser 31, and designed so that when attached to the line 6 then the lampshade or diffuser 6 fits over one or more of the lighting nodes 2 in between the two clips 5, 5'.

Figure 11:
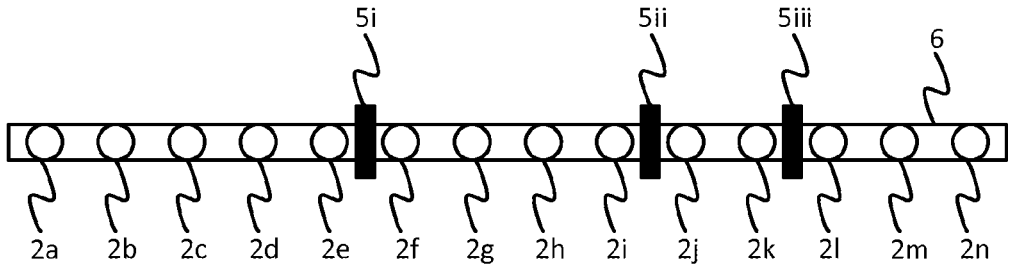
FIG. 11 is a schematic illustration of an LED strip with clips attached.

As another example, the clip 5 or clips 5, 5' (etc.) may be designed to physically secure or mount the line 6 including the lighting array onto a luminaire structure such as one or more arms of a chandelier 44 (see FIG. 11).

Furthermore, in embodiments, each of one or more of the clips 5 may be configured to enable the controller to detect what type of luminaire element 31, 44 the clip 5 supports or is supported by. In these embodiments, the logic 24 in each such clip 5 is programmed with an indication of the type. For instance, the type of luminaire element may be specified from amongst a set comprising some or all of: a decorative luminaire element, a passive optical element, a structural luminaire element, and/or no luminaire element. E.g. the type of luminaire element may be specified from amongst a set comprising some or all of: a light shade, a light diffusing element, a chandelier arm, and/or no luminaire element. When the clip 5 reports the ID of its neighbouring lighting node(s) 2 to the controller 7, it also reports the indication of its type (again over the bus 16 via the connection 28 formed by the clip 5). Alternatively, the logic 12 in the neighbouring lighting node 2 reads the type from the clip 5 via the bus 16, and reports this to the controller 7 via the bus.

Either way, this provides further information based upon which the controller 7 can control the lighting effects. For instance, on the basis of detecting whether or not each segment is covered by an element 31 such as a lampshade or diffuser, the controller 7 may apply one dim level and/or colour for the illumination emitted by lighting nodes 2 in a segment covered by such an element, and another, different dim level and/or colour for the illumination from lighting nodes 2 not in a segment covered by such an element. Alternatively or additionally, the controller 7 may apply different dim levels and/or colours for segments covered by different types of luminaire element 31, e.g. depending on whether covered by an open-ended lampshade or completely enclosed by a diffuser.

The type may be identified based on an ID of the clip 5 or its luminaire element 31 transmitted over the bus 16 via the connection 28, or read from the clip 5 via the bus 16. The controller 7 may then look up the type associated with the ID in a look-up table. Note that a similar technique can also be extended to identifying other properties of the luminaire element 31, e.g. shape, size and/or colour. Further, an ID look-up is not the only way to identify type or other property of the luminaire element 31. E.g. the system could be equipped with a sensor such as a camera plus image recognition algorithm arranged to identify the type, shape, size or colour of a luminaire element 31.

Figure 8:
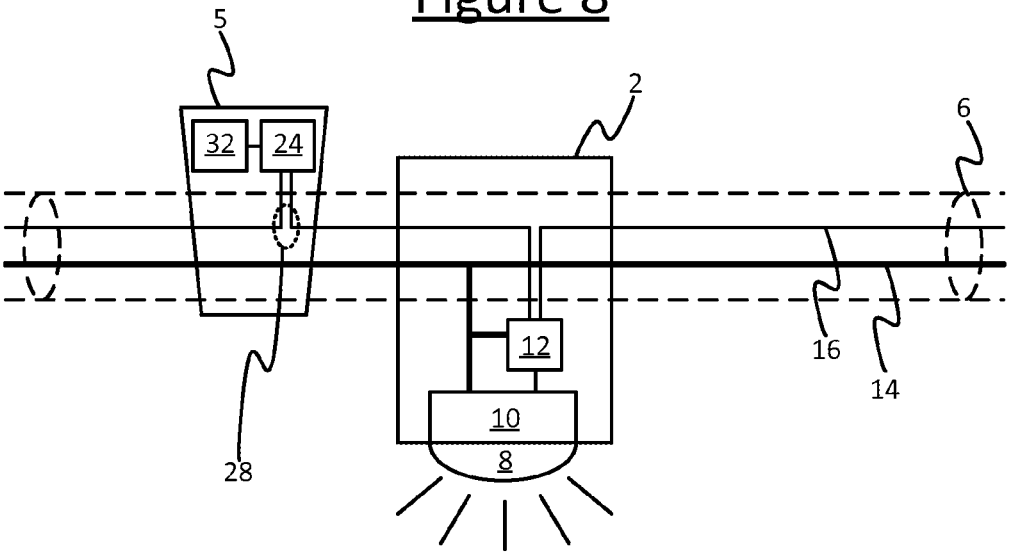
FIG. 8 is another schematic illustration of a lighting node and clip connected to a supporting line.

Another variant is illustrated in FIG. 8. This variant illustrates that the clip 5 does not necessarily have to connect to the power line 14 at all. Instead the clip 5 may comprise a small battery 32 connected to power the clip's divider logic 24. In such cases, the clip may comprise no power branch 15 and no power connection 26 at all. Alternatively, even though a connection to the power line 14 is not needed to power the divider logic 24, such a connection 26 may nonetheless be provided to supply power to supplement the power line 14 (see again element 17 in FIG. 4).

Figure 9:
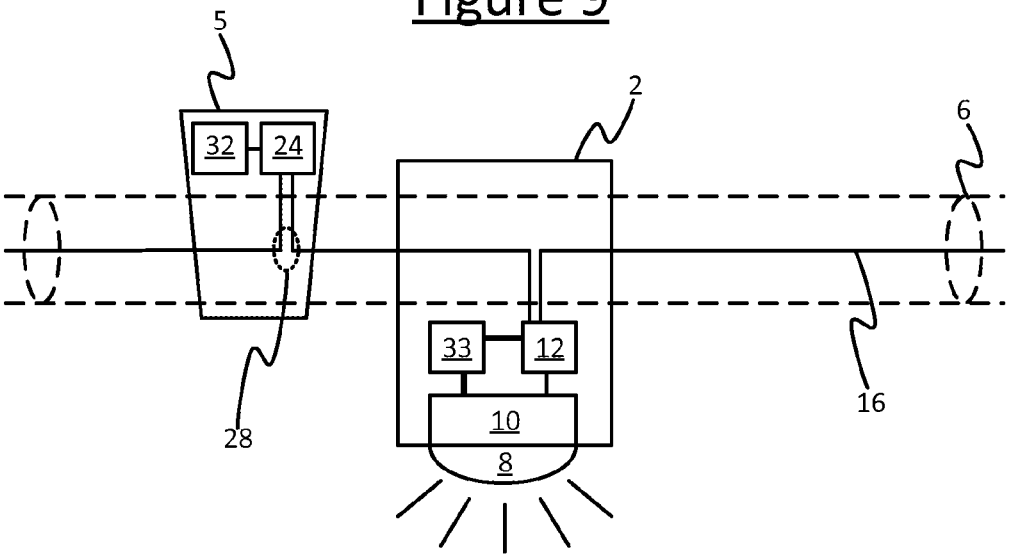
FIG. 9 is another schematic illustration of a lighting node and clip connected to a supporting line.

FIG. 9 illustrates another variant in which a power line 14 is not necessary at all. Here, as well as the battery 32 in the clip(s) 5, each of the lighting nodes 2 is also powered by its own battery 33.

Figure 10:
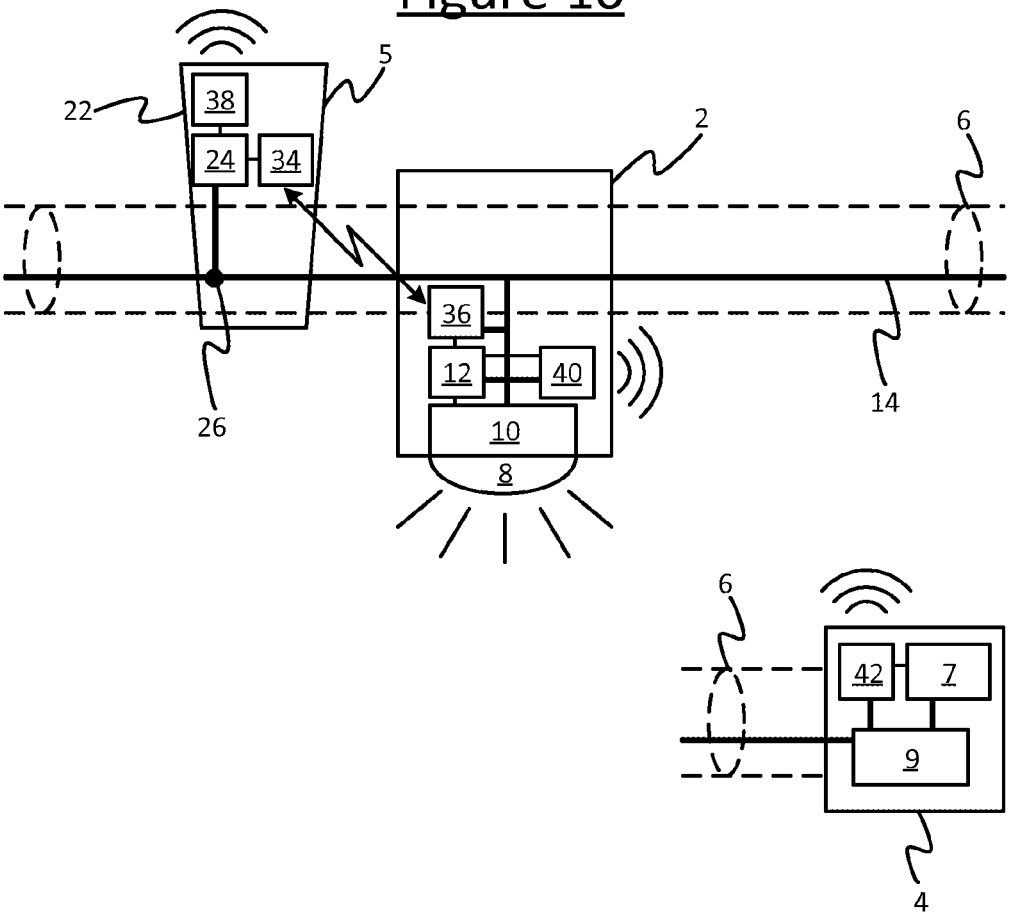
FIG. 10 is another schematic illustration of a lighting node and clip connected to a supporting line.

FIG. 10 shows yet another variant, illustrating that a wired data bus 16 is not necessary in all possible embodiments. Here, the control equipment 4 (e.g. control box) comprises a wireless interface 42 coupled to the controller 7, and each lighting node 2 also comprises a respective wireless interface 40 coupled to its respective local control logic 12. Thus, by communicating via the controller's wireless interface 42 and a lighting node's wireless interface 40, this enables the controller 7 to communicate with the control logic 12 in each of the lighting nodes 2 in order to send the lighting control commands wirelessly instead of over a wired bus 16, and also in embodiments to receive reports back from the logic 12 in the lighting nodes 2.

Further, each of the clips 5 also comprises a respective wireless interface 38 coupled to its respective divider logic 24. This enables the logic 24 in the clip 5 to report back to the controller 7 via the clip's wireless interface 38 and the controller's wireless interface 42.

Note that any suitable wireless access technology may be used for any of these communications, e.g. ZigBee, Bluetooth, Wi-Fi or Thread. A combination could also be used in the case where one or more of the interfaces 38, 40, 42 is only configured to operate according to a different wireless access technology than another of the interfaces it needs to communicate with. In such case a wireless bridge (not shown) may be introduced to covert the relevant communications between the two technologies. For instance, the wireless interface 42 of the may be configured to operate according to a first wireless access technology such as Wi-Fi, whereas the interface 38, 40 in each of the clips 5 and/or lighting nodes 2 may be equipped to operate according to a second, different wireless access technology such as ZigBee. In such cases, a lighting bridge may be disposed within range of all of the interfaces 38, 40, 42 in question. The controller 7 can then send lighting control commands to the lighting nodes 2 and/or receive reports back from the lighting nodes 2 via the bridge, which converts between the first to the second access technology. Similarly, the controller 7 may receive reports back from the clip 5 via the bridge which again converts between the first and second wireless access technologies.

In addition to the above-described wireless communications, the clip 5 may also comprise a wireless transducer 34 arranged to enable the position of the clip 5 relative to the lighting nodes 2 or line 6 to be detected wirelessly. In embodiments the wireless transducer 34 comprises a receiver configured to receive signals according to a near-field communication (NFC) technology, e.g. an RF tag reader, and each of the lighting nodes 2 is equipped with a transmitter 36 configured to transmit signals according to an NFC technology, e.g. an RF tag.

When the clip 5 is clipped to the line 6 in proximity to one of the lighting nodes 2 (within range according to the NFC technology in question), the NFC receiver 34 in the clip 5 receives the address of the lighting node 2 from the lighting node logic 12 via the NFC transmitter 36 in the lighting node 2, and passes this to the clip's divider logic 24, which then communicates this wirelessly to the controller 7 via the wireless interfaces 38, 42. Thus the position of the clip 5 can be detected, and the controller 7 can control the lighting in dependence on this in an otherwise similar manner as already described previously. Note also that the NFC transmitter 36 does not necessarily have to be implemented in the lighting node 2, but in fact could instead embedded in the supporting line 6 (e.g. strip) itself. Or as another example, the roles of the NFC transmitter 36 and receiver 34 may be reversed. That is, the transducer 34 in the clip 5 may be an NFC transmitter (e.g. RF tag) and the complementary component 36 in the lighting node 2 may be an NFC receiver (e.g. RF tag reader). In this case the logic 12 in the lighting node 2 uses the NFC receiver 36 in the lighting node 2 to detect when the NFC transmitter 34 in the clip 5 is in proximity, and via the NFC transmitter and receiver 34, 36 to receive the ID of the clip 5, which the lighting node's logic 12 then communicates wirelessly to the controller 7 via the wireless interfaces 40, 42.

Various combinations of the variations shown in FIGS. 3 to 10 may also be used. E.g. one embodiment could use the wireless detection based on the wireless transducer 34 in the clip 5 to detect the position of the clip 5, but still use a data bus 16 to communicate the result to the controller 7 (instead of the wireless control communication via the above-described wireless interfaces 38, 40, 42).

Yet another alternative approach is through the use of light sensor(s) embedded in the LED strip 6. In this case the clips 5 are attached at the start and end of a luminaire element 31 such as a lampshade. The clips are positioned over the LEDs of one or more nodes 2, and a light sensor in each such node or the adjacent line 6 (e.g. embedded in the LED package) detects the light reflected back from the clip to determine whether a clip is placed there or not. That is, each of the attachable dividers 5 may comprise a reflecting surface configured to reflect back light from at least one of the neighbouring lighting nodes 2 to a light detector included in the neighbouring lighting node 2 or in the supporting line 6. By communicating a detection of this back to the controller 7, along with an ID of the light sensor or lighting node 2, this enables detection of the clip's position.

This can be extended by adding different colours to the clips such that different clips may be detected by the LED strip. These different clips are attached to different types of lampshade or sections of a luminaire. This then allows the detection of these different types of lamp shade or luminaire sections. The controller in the luminaire to which the LED strip is connected can change the settings of the LEDs to match the required light settings. For example the LEDs connected between two clips may be set to full brightness, whilst the other LEDs may be switched off (or set to some decorative light setting).

Some example applications of the disclosed techniques are now discussed with reference to FIGS. 11 to 14.

Referring to FIG. 11, the clips 5 could define a certain light transformation. For example instead of switching off or maximizing the brightness, the clip 5 can define the change in level of brightness, e.g. reduce brightness in half, where the original brightness is that set by the system. In this case the segments can also be "infinite" i.e. reduce brightness in half starting from that point till the end of the strip. E.g. the brightness after clip 5*i* may be divided in half, then divided in half again after clip 5*iii*, then again by a half after clip 5*iii*, etc.

Figure 12:
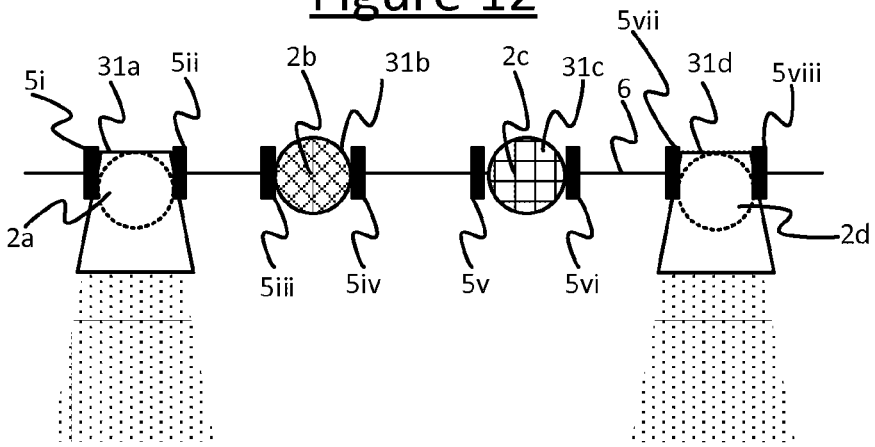
FIG. 12 is a schematic illustration of a linear lighting array with decorative elements attached by means of clips.

Another application is illustrated in FIG. 12. The disclosed techniques can be used to create customizable, do-it-yourself luminaires. For example a package may contain a LED strip 6, a wire (acting as mechanical support) with some transparent clips and some lamp shades 31*a*-31*d* with different coloured clips 5*i*-5*viii*. The wire can be mounted between two walls, the LED string 6 can be mounted to the wire with the transparent clips, and the lampshades 31*a*-31*d* can be connected to the LED strip 6 using the coloured clips 5*i*-5*viii*. Once the user has connected the LED strip 6 to the wire and placed the lampshades 31*a*-31*d*, he connects the LED string 6 to the controller 7 and switches on the power. The system detects the location of the coloured clips 5*i*-5*viii*. The LEDs 2*a*-*d* that are in between two coloured clips (5*i*, 5*ii*; 5*iii*, 5*iv*; etc.) light up while the others remain off.

Note that the function of the coloured clips 5*i*-5*viii* may also be embedded into the lamp shades 31*a*-31*d* directly. For example the clips at one end are permanently attached to the lampshade, and opening the clips allows the user to insert the LED string, whilst when closed the lampshade is then attached to the LED string 6.

Figure 13:
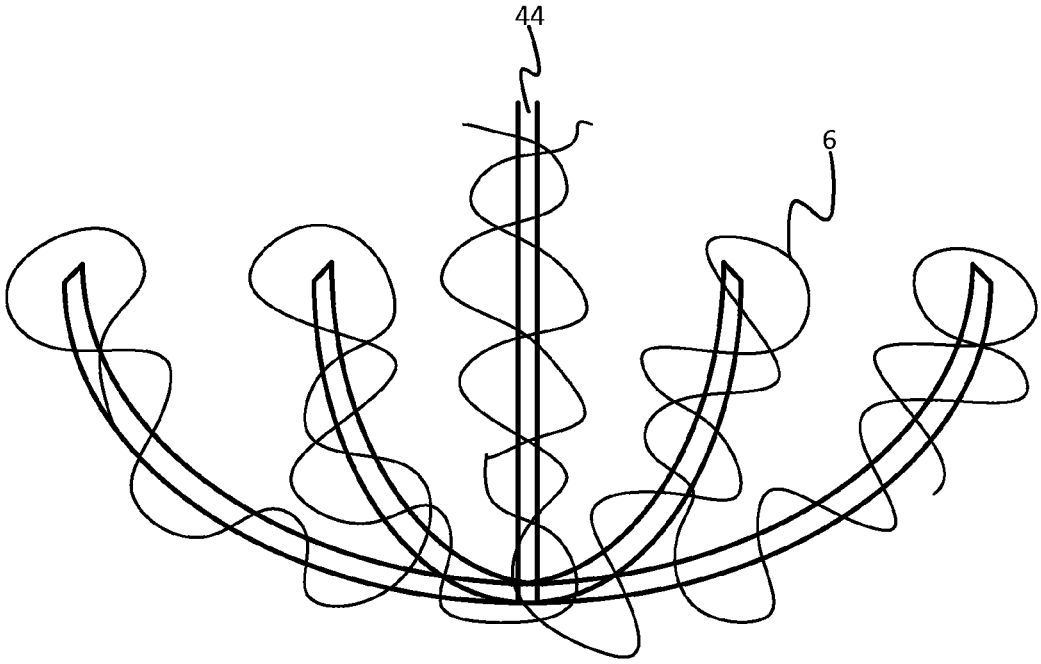
FIG. 13 is a schematic illustration of a chandelier adorned with a linear lighting array.

Referring to FIG. 13, another application is a luminaire, for example a chandelier 44, consisting of a base part and several arms where the user can drape the LED strip 6 over parts of the chandelier 44. At the ends of the arms the user can make a loop of the LED strip to create more light, over these loops he can then mount a lampshade. The mounting of the LED strip 6 to the luminaire elements is done using clips 5 with different identification (RFID, colour or a combination), the location and IDs of the clips 5 are detected to determine which LEDs should be switched on and which LED's should be switched off or set to a decorative light setting.

Figure 14:
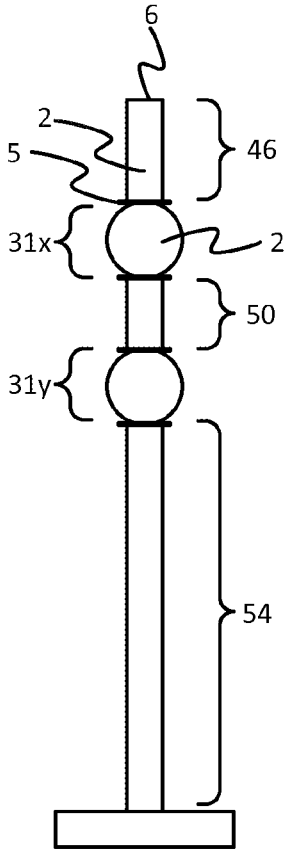
FIG. 14 is a schematic illustration of a vertical linear lighting array disposed on a pole or other such vertical supporting line.

A fourth example is illustrated in FIG. 14. Here the luminaire may be a floor-standing vertical linear LED array, whereby the LEDs 2 are either integrated in the back side, or at multiple sides to create light in multiple directions. The user can attach elements 31*xm* 31*y* on the pole 6, for instance, spherical elements may have a hole enabling them to be attached and shifted up and down the pole. The pole 6 would detect the position and possibly a property (such as type, shape, size or colour) of the element 31*z*, 31*y* and adjust the light accordingly. In a first example, the pole would only activate the light nodes 2 which are positioned inside the element 31*x*, 31*y*, and leave the other light nodes off. In another example, the light pole 6 would create a first light effect for all light nodes outside (e.g. a purple light effect) and create a second light effect (e.g. a yellow light effect) only at the nodes which are positioned inside the element(s) 31*x*, 31*y*. From a technical perspective, each light node 2 would by default react to one light control signal A, whereas the light nodes which detect a nearby element will react to another light control signal B.

In yet further embodiments, if the LED strip (or other such linear array) 6 is extended with one or more accelerometers (preferably three-axis accelerometers) then also the orientation of LEDs or lighting nodes 2 that are in a section between two clips 5 can be taken into account. In such embodiments, logic associated with each accelerometer is arranged to communicate the respective accelerometer reading back to the controller (e.g. via the bus 16 or via a wireless channel between wireless interfaces of the line 6 and controller 7). The controller 7 may then control the lighting from the corresponding living node or nodes 2 in dependence on the respective accelerometer reading. For example in a hanging luminaire, LEDs facing upwards or downwards may emit more light than those pointing to the side, where also the type of lampshade may be taken into account (as this can be determined from the clips 5 that are used to attach the lampshade 31 to the LED strip 6 or vice versa).

It will be appreciated that the above embodiments have been described only by way of example. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A kit of parts comprising:

a linear array of lighting nodes connected at different respective positions along a flexible, rigid or malleable continuous supporting line, each of the lighting nodes comprising one or more lighting elements for emitting illumination;

one or more attachable dividers configured to be attachable by a user onto said line without severing the line, or at least without completely severing the line, each between a respective neighbouring pair of the lighting nodes, by means of a mechanical attachment; and a controller for controlling the illumination emitted by each of the lighting nodes;

wherein each of the attachable dividers is configured so as, when attached onto the line, to enable detection of a position at which the divider is connected along the line relative to the lighting nodes, and configured to provide information related to said position to the controller, and thereby divide the lighting nodes into different segments along the line;

wherein the controller is configured to apply a different lighting effect to the illumination emitted by the lighting nodes in each of some or all of the different segments;

a sequential data link connecting a linear sequence of data nodes, each but a first of the data nodes in the sequence being arranged to receive data from a preceding one of the data nodes in the sequence and pass the data to a next one of said data nodes in the sequence;

wherein said lighting nodes each comprise a respective one of the data nodes; and wherein each of the attachable dividers is configured so as, when attached to the supporting line by said mechanical attachment, to intersect the data link to become another of said data nodes, and thereby communicate with at least one of the respective pair of neighbouring lighting nodes in order to enable said detection.

2. The kit of claim 1, wherein each of the attachable dividers comprises a clip for implementing said mechanical attachment by clipping to the supporting line.

3. The kit or system of claim 1, comprising a power line arranged to power each of the lighting nodes; wherein each of the attachable dividers is configured so as, when attached to the supporting line by said mechanical attachment, to connect to the power line and thereby draw power to power the attachable divider.

4. The kit or system of claim 1, comprising a power line arranged to power to each of the lighting nodes; wherein each of the attachable dividers is configured so as, when attached to the supporting line by said mechanical attachment, to connect to the power line and thereby supply power for powering the lighting nodes.

5. The kit or system of claim 1, wherein the data link or power line is comprised within the supporting line.

6. The kit or system of claim 5, wherein each of the attachable dividers comprises contacts for piercing the supporting line to make electrical contact with the data link to perform said communication with the at least one neighbouring lighting node, or for piercing the supporting line to make electrical contact with the power line in order to perform said drawing or supply of power.

7. The kit or system of claim 1, wherein each of the attachable dividers comprises a blade for severing at least the data link in order to create said intersection.

8. The kit or system of claim 1, wherein:

each of the attachable dividers is configured to enable said detection based on a wireless signal transmitted or reflected between the attachable divider and at least one of the respective pair of neighbouring lighting nodes, or between the attachable divider and a component embedded in the line.

9. The kit or system of claim 1, wherein at least one of the attachable dividers is further arranged to mechanically support or be supported by a luminaire element.

10. The kit or system of claim 9, wherein:

each of the attachable dividers is configured to enable said detection by communicating with at least one of the respective pair of neighbouring lighting nodes or with a component embedded in the line;

for said at least one attachable divider, said communication between the attachable divider and the at least one neighbouring lighting node further enables identification of a property of the luminaire element; and the controller is configured to control the lighting effect in one of the segments bounded by said at least one attachable divider in dependence on the identified property of the luminaire element.

11. A system comprising:

a linear array of lighting nodes connected at different respective positions along a flexible, rigid or malleable continuous supporting line, each of the lighting nodes comprising one or more lighting elements for emitting illumination;

one or more attachable dividers attached onto said line without severing the line, or at least without completely severing the line, each between a respective pair of the lighting nodes, by means of a mechanical attachment; and a controller arranged to control the illumination emitted by each of the lighting nodes;

wherein each of the attachable dividers is configured so as, when attached onto the line, to enable detection of a position at which the divider is attached along the line relative to the lighting nodes, and configured to provide information related to said position to the controller, and thereby divide the lighting nodes into different segments along the line; and wherein the controller is configured to apply a different lighting effect to the illumination emitted by the lighting nodes in each of some or all of the different segments;

a sequential data link connecting a linear sequence of data nodes, each but a first of the data nodes in the sequence being arranged to receive data from a preceding one of the data nodes in the sequence and pass the data to a next one of said data nodes in the sequence;

wherein said lighting nodes each comprise a respective one of the data nodes; and wherein each of the attachable dividers is configured so as, when attached to the supporting line by said mechanical attachment, to intersect the data link to become another of said data nodes, and thereby communicate with at least one of the respective pair of neighbouring lighting nodes in order to enable said detection.

12. A method performed in relation to a linear array of lighting nodes connected at different respective positions along a flexible, rigid or malleable continuous supporting line, each of the lighting nodes comprising one or more lighting elements for emitting illumination; the method comprising:

attaching one or more attachable dividers onto said line without severing the line, or at least without completely severing the line, each between a respective neighbouring pair of the lighting nodes, by means of a mechanical attachment;

employing a controller for controlling the illumination emitted by each of the lighting nodes;

using each of the attachable dividers so as, when attached to the line, to detect a position at which each of the attachable dividers is connected along the line relative to the lighting nodes, and thereby the lighting nodes into different segments along the line;

providing information related to said position to the controller;

operating the controller to apply a different lighting effect to the illumination emitted by the lighting nodes in each of some or all of the different segments;

connecting, using a sequential data link, a linear sequence of data nodes, each but a first of the data nodes in the sequence being arranged to receive data from a preceding one of the data nodes in the sequence and pass the data to a next one of said data nodes in the sequence;

wherein said lighting nodes each comprise a respective one of the data nodes; and wherein each of the attachable dividers is configured so as, when attached to the supporting line by said mechanical attachment, to intersect the data link to become another of said data nodes, and thereby communicate with at least one of the respective pair of neighbouring lighting nodes in order to enable said detection.

* * * * *